United States Patent [19]

Fredd

[11] 4,280,561

[45] Jul. 28, 1981

[54] VALVE

[75] Inventor: John V. Fredd, Dallas, Tex.

[73] Assignee: Otis Engineering Corporation, Dallas, Tex.

[21] Appl. No.: 53,782

[22] Filed: Jul. 2, 1979

[51] Int. Cl.[3] ..... E21B 43/12

[52] U.S. Cl. ..... 166/332; 166/316; 251/297; 251/319

[58] Field of Search ..... 166/332, 154, 289, 323, 166/316; 251/319, 297

[56] References Cited

U.S. PATENT DOCUMENTS

| | | | |
|---|---|---|---|
| 2,380,022 | 7/1945 | Burt | 166/289 |
| 3,100,537 | 8/1963 | Crowe | 166/154 |
| 3,306,365 | 2/1967 | Kammerer, Jr. | 166/154 |
| 3,768,562 | 10/1973 | Baker | 166/289 |
| 4,176,717 | 12/1979 | Hix | 166/154 |

*Primary Examiner*—James A. Leppink

*Attorney, Agent, or Firm*—Vinson & Elkins

[57] ABSTRACT

A sleeve valve which may be made up as a part of a tubing string in which the valve member has two positions. Dogs carried by the valve member alternately cooperate with spaced grooves in the body in said positions. The dogs are alternately engageable by a shifting tool to shift the valve member in opposite directions and after the valve member has been shifted, the dogs are disengaged from the shifting tool. The valve is disclosed as a part of a testing system employing a circulating tool, a cushion valve, a seal unit, and a landing nipple with a transducer fitting.

5 Claims, 2 Drawing Figures

VALVE

This invention relates to valves. In one form, it relates to valves which may form a part of a tubing string. Preferably, the valve depends from a well packer.

In many instances it is desirable to be able to shift a sleeve between open and closed position. It is also frequently desirable to shift the sleeve with an operating tool which after the sleeve is shifted is released so that the positioning of the shifting tool is not critical or the shifting tool may move a further distance to perform other functions or to land other equipment, or for other reasons it is desirable that the valve member be shifted and then released.

In the testing of wells, it is frequently desirable to be able to selectively produce the well through the tubing. In some instances, it is desirable to provide a sleeve valve, preferably depending from a packer, with ports which may be opened and closed to provide for flow from the well through the valve.

It is an object of this invention to provide a valve having a valve member shiftable between open and closed positions in which the shifting tool is released from the valve member automatically upon the valve member reaching either its open or closed position.

Another object is to provide a valve as in the preceding object with a shutter to protect the seals in the system which shutter is automatically operable in response to movement of the valve member.

Another object is to provide a valve such as a sleeve valve with spaced dogs which are engageable by a shifting tool to move the valve member between open and closed position and in which the dogs are engaged by a shifting tool and then release the shifting tool as they move into cooperating grooves to alternately latch the valve member in open or closed position.

Another object is to provide a sleeve valve with latching collets in which the collets are protected against damage during shifting of the valve member.

Other objects, features and advantages of this invention will be apparent from the drawings, the specification and the claims.

In the drawings wherein like reference numerals indicate like parts and wherein an illustrative embodiment of this invention is shown:

Figure 1:
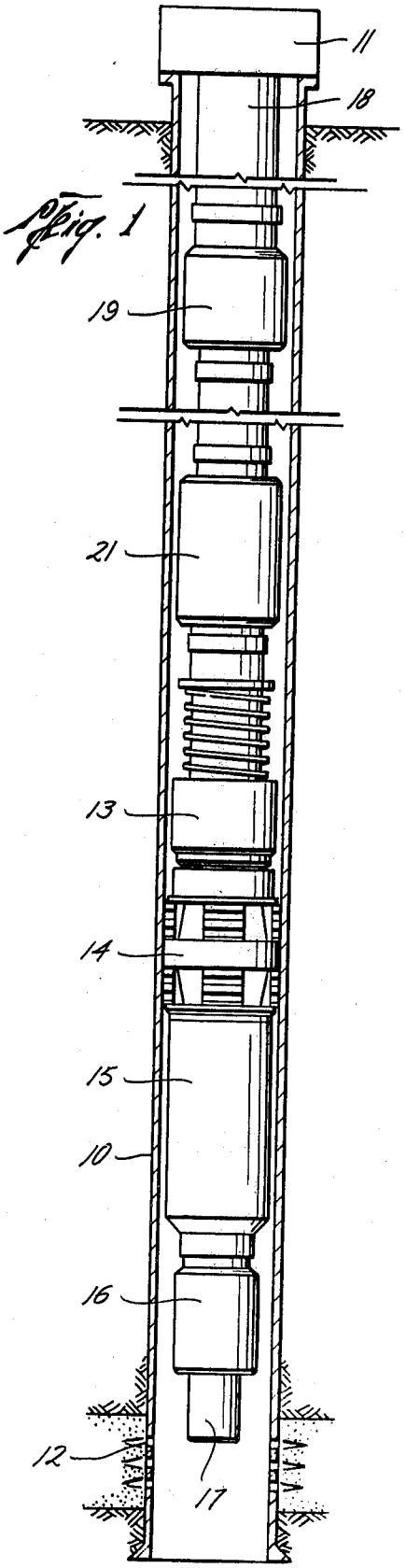
FIG. 1 is a schematic illustration of a well test installation employing the valve of this invention.

Referring first to FIG. 1, there is shown a well having a casing 10 and standard surface equipment 11 at the top of the well. The casing and well are shown to be perforated at 12 into the formation to be tested.

Within the well there is an assembly made up of a packer 14, foot valve 15, landing nipple 16, and transducer fitting 17 which are preferably run into the well and landed in place in a preliminary operation as by conventional wire line techniques.

The test or production tubing 18 is shown to have a circulating valve 19, a cushion valve 21, and a seal unit 13 with the tail pipe of the seal unit in sealing engagement with the packer 14. During running of the tubing 18, the cushion valve may be utilized to support a column of fluid in the tubing which is released by opening of the cushion valve when the string engages the packer 14.

The packer 14 packs off the producing formation and the foot sleeve valve 15 controls the flow through the foot sleeve and into the tubing. The landing nipple and transducer fitting provide for landing a transducer such as a pressure sensing device within the fitting to sense the pressure in the casing and below the packer. With this assembly, static pressure in the formation below the packer as well as build-up pressure can be recorded or transmitted to the surface through a suitable electric line and flow can be provided through the foot sleeve valve to test the flow characteristics of the well.

During testing operation, the circulating valve 19 is normally closed. Conditions may arise, however, when it is desirable or imperative to provide for circulation between the casing-tubing annulus and the tubing. The circulating valve 19 may be quickly and readily opened to provide for such circulation.

The valve of this invention may be used in any desired setting. It was developed, however, to form a part of the testing system shown and its construction and operation will be explained in this setting. The invention, however, is not restricted to the system shown and the valve may be positioned other than in the relationship shown. For instance, it could be used as a circulating valve between the casing-tubing annulus and the bore of the tubing. It also might be positioned above the packer with suitable flow passages provided through the packer and connected to the controlled flow way through the valve body.

In the system shown, the valve, which would conventionally be called a foot sleeve valve, is shown to be carried by the packer 14 and to have attached to its lower end additional equipment such as the landing nipple 16 and the transducer fitting 17 which close the lower end of the assembly. Of course, other or different equipment could be depended from the sleeve valve 15.

Figure 2:
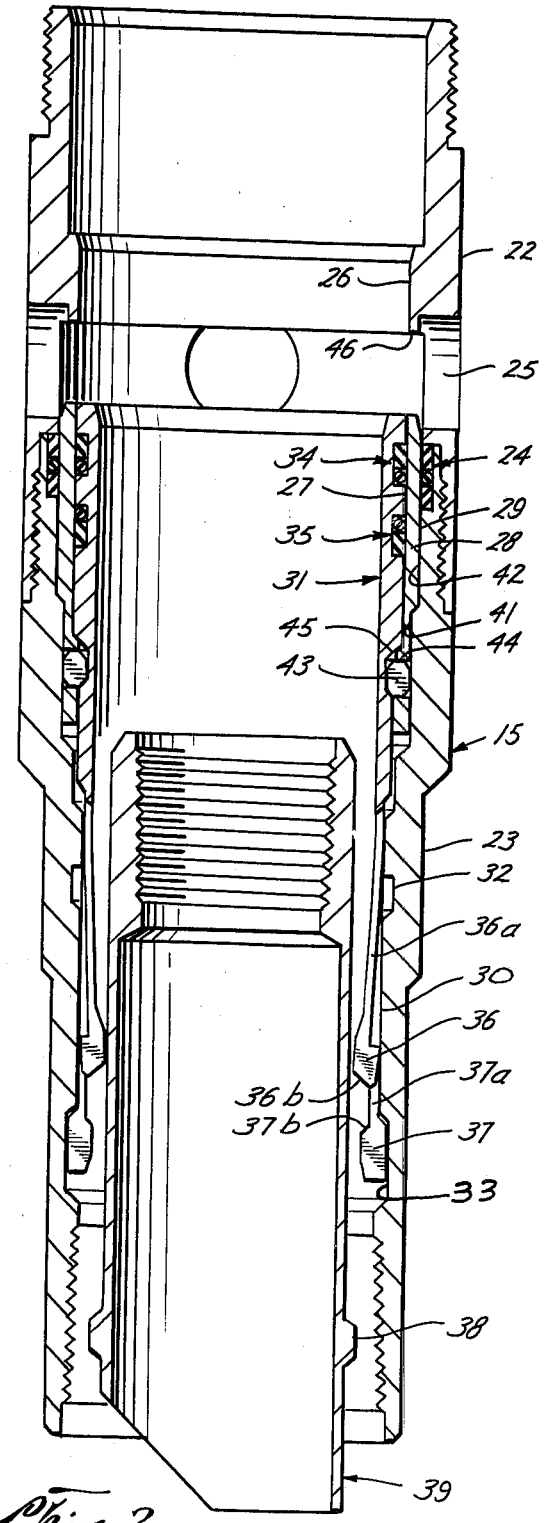
FIG. 2 is a cross-sectional view through a valve constructed in accordance with this invention and showing therein in cross-section an operating tool.

Referring to FIG. 2, the body of the sleeve valve 15 is shown to be provided by a ported collar 22 provided with threads at its upper end for attachment to packer 14 and a lower body member 23 provided at its lower end with a thread system to which the landing nipple 16 may be threadedly attached. The two piece body is conveniently made in this form to provide easy access to a recess in which the seal indicated generally at 24 may be positioned.

The body is provided with a valve seat for controlling flow through the ports 25. In the form of a valve illustrated, the bore 26 through the collar 22 provides a portion of the valve seat. In the form of valve illustrated, the shutter 28 provides the remainder of the valve seat. In this form of valve, the internal bore 27 through the shutter 28 provides the remainder of the seat. The exterior surface 29 of the shutter cooperates with the seal indicated generally at 24 to complete the seal between the body and shutter.

To provide a part of a system for alternately positioning the valve member indicated generally at 31 in open or closed position, the lower valve body 23 is provided with spaced annular grooves 32 and 33. The cooperation of these grooves with the positioning means will appear hereinbelow.

The valve member 31 is cooperable with the valve seat and movable between open and closed positions to control flow through the valve seat. Preferably, the valve is provided by a tubular valve member such as the valve member 31 having seal systems 34 and 35 carried in grooves on the exterior of the tubular valve member. The seal 34 cooperates with the portion 26 of the valve seat to provide a seal and the seal 35 cooperates with the shutter 28 to provide a seal. These seals, together with the shutter-body seal 24 control flow through the ports 25 by permitting flow when the valve member 31 is in the position shown and preventing flow when the valve member is moved toward the collar 22 until the seal 34 is in engagement with the seat 26.

In order to provide for shifting of the valve member 31, the valve member carries spaced dog means which are resiliently urged in a radial direction. Where the dog receiving grooves 32 and 34 are positioned radially outward from the valve member as shown in the illustrative embodiment, the dogs are preferably urged outwardly from the position they occupy when the dogs are not in a groove. It is further preferred that the dog means be provided by collets. It is still further preferred that the collets be an integral part of the valve member. As shown in the illustrative embodiment, the valve member includes collets 36 and 37 which provide spaced dog means carried by the valve member. These collets are preferably machined from the same blank of material as the valve member and the resiliency of the collet legs 36*a* and 37*a*, when bent, provides the resilient means urging the dogs outwardly into engagement with the grooves 32 and 33.

Intermediate the grooves 32 and 33, the valve body is provided with land 30 which also cooperates with the spaced collets and support them against damage when they are not in grooves 32 and 33.

The dogs have confronting shoulders 36*b* and 37*b* which cooperate with a flange such as flange 38 on the actuator tool indicated generally at 39 to provide for operation of the valve. It will be apparent from the dimensional relationship of the actuator flange 38 and the internal diameter of the collets 36 and 37 that movement of the actuator tool 39 through the valve will cause it to first engage the collet which is opposite the land 30 to shift the valve member until the collet can drop into its associated groove and then the flange 38 on the actuator tool is released to permit the actuator tool to continue movement in the same direction. As the engaging surfaces of the flange 38 and dogs 36 and 37 are angled and wedge the dogs outwardly the land 30 protects the dogs against damage during shifting of the valve member 31. Of course, as the actuator tool moves in the manner explained, the other of the collets is retracted behind the actuator tool flange to position it for engagement by the actuator tool flange on reverse direction of movement of the actuator tool.

When the dogs are biased inwardly by the land 30, the resiliency of the collet fingers urge the dogs outwardly into the grooves with which they respectively cooperate as the dogs move off of the land 30.

It is preferred that the valve of this invention include a shutter to protect the seals 34 and 35 as the valve member is shifted between open and closed positions. Preferably, the shutter 28 is provided in an annulus between the valve member and the body. This annulus is preferably of two different diameters as shown at 41 and 42 to cooperate with shutter lugs 43 carried in ports 44 in the shutter and the groove 45 in the valve member 31. When the shutter lugs are in engagement with the bore 41, they also reside in the groove 45 in the valve member and the shutter moves with the valve member. When the lugs are opposite the bore 42, they move out of the groove 45 in the valve member and the valve member is free to move without moving the shutter at the same time. The shutter is limited in movement by the shoulder provided between the different diameter sections 41 and 42 and by the stop 46 in the ported collar 22.

In use, the foot sleeve valve is carried by the packer 14 and the packer and the sleeve valve and associated equipment therebelow are run into the well as with a wire line and the packer is set in position as shown in FIG. 1. Preferably, there is carried on the tubing a seal unit 13 which has an actuator therein to which the operator shown at 39 in FIG. 2 is attached so that manipulation of the actuator in the seal unit 13 will move the operator 39 vertically in the well and effect opening and closing of the foot sleeve valve.

The foot sleeve valve will normally be closed and the actuator 39 positioned with its actuating flange 38 above the collet 37 as viewed in FIG. 2 with the valve member in its up or closed position and the collet 36 residing in groove 32. As the position of the actuator is not critical, it may be in any position above the shoulder 37*b* of collet 37 with the collet 36 in the groove 32. Movement of the actuator downward as viewed in FIG. 2 moves the flange 38 into engagement with the shoulder 37*b* on collet 37. Continued movement of the actuator begins movement of the valve member downwardly as viewed in FIG. 2. At this time, the shutter lug 43 is in engagement with the bore 42 and the groove 45 will be spaced above the shutter lug. With the shutter held in the closed position, the valve member moves into the shutter until the seal 34 has passed over the abutment 46 and the seal 34 resides within the protection of the shutter 28. At this time, the groove 45 moves behind the lug 43 and the lug falls into the groove and the shutter moves with the valve member. The valve member continues to move downwardly as viewed in FIG. 2 until the collet 37 snaps into the groove 33 in the valve body and in so doing releases the actuator flange 38 thus permitting the flange to continue movement downwardly without effect on the valve member. The valve is now in full open position and flow takes place through the ports 25. When it is desired to close the valve, the seal unit 13 is operated to raise the actuator and move the flange 38 up into engagement with the collet 36 which is now held in contracted position by the land 30. The flange 38 engages the shoulder 36*b* of collet 36 and moves the system upwardly as viewed in FIG. 2. After the shutter has moved into engagement with stop 46, the valve member continues movement upwardly as the lug 43 is released to move the seal 34 over seat 26 and block flow through the valve. As the collet 36 moves into the groove 32, the actuating flange 38 is released and the actuator may continue upward movement. At this time, the collet 37 is held in its retracted position by the land 30 and is in position to be engaged by the actuator flange 38 if the actuator is again moved downwardly. It will be appreciated that the actuator is free to move upwardly after the valve is fully closed and thus the relationship of the actuator flange and the collets again is not critical.

It will be appreciated that the valve may be opened and closed as many times as desired merely by reciprocating the actuator 39.

The frictional engagement of the parts will normally prevent overrun of the valve member upon release of the flange 38. To insure against upward overrun the upwardly looking face of lug 36 is square and engages a flat downwardly looking shoulder in groove 32. Downward overrun is prevented by the valve member shouldering on the shutter 28 which in turn shoulders in body 23. If desired, overrun could be prevented in other ways such as a square shoulder looking upwardly in groove 33 to cooperate with dog 37.

The foregoing disclosure and description of the invention are illustrative and explanatory thereof, and various changes in the size, shape and materials, as well as in the details of the illustrated construction, may be made within the scope of the appended claims without departing from the spirit of the invention.

What is claimed is:

1. A valve comprising, a body having a valve seat, a valve member cooperable with said seat and movable in both directions between open and closed positions to control flow through said valve seat, spaced internal grooves in the body with their adjacent walls converging outwardly of the groove, land means in the body intermediate said grooves, spaced dog means carried by the valve member and resiliently biased to alternately engage one of said spaced grooves and land means and position the valve member alternately in open or closed positions, said dog means when engaged with said groove expanding to a first selected diameter and when engaged with said land means contracting to a selected lesser second diameter, an actuator having a circumferential actuator flange thereon having a radial outer dimension between said first and second selected diameters, said spaced dog means having confronting shoulders engageable by said flange on said actuator member when a dog is in engagement with said land means to shift the valve member with reciprocation of the actuator member, each of said dog means releasing said actuator member flange as a dog means enters its cooperating groove permitting the actuator flange to move beyond the dog means while the other of said dog means remains retracted for engagement by said actuator member flange when reciprocated in the opposite direction.

2. A valve comprising, a body having a valve seat, a valve member cooperable with said seat and movable in both directions between open and closed positions to control flow through said valve seat, spaced internal grooves in the body with their adjacent side walls converging outwardly of the groove, land means in the body intermediate said grooves, spaced dog means carried by the valve member and resiliently biased to alternately engage one of said spaced grooves and land means and position the valve member alternatively in open or closed positions, said dog means when engaged with said groove expanding to a first selected diameter and when engaged with said land means contracted to a selected lesser second diameter, said spaced dog means having confronting shoulders engageable by a flange on an actuator member having a circumferential flange thereon having a radial outer dimension between said first and second selected diameters when a dog means is in engagement with said land means to shift the valve member with reciprocation of the actuator member, each of said dog means releasing said actuator member flange as a dog means enters its cooperating groove permitting the actuator flange to move beyond the dog means while the other of said dog means remains retracted for engagement by said actuator member flange when reciprocated in the opposite direction.

3. A valve comprising, a body having a valve seat, a sleeve valve member cooperable with said seat and movable between open and closed positions to control flow through said valve seat, seal means on the exterior of said valve member, a valve shutter around the valve member, spaced grooves in the body, spaced dog means carried by the valve member and resiliently biased to alternately cooperate with one of said spaced grooves and position the valve member alternatively in open or closed positions, said spaced dog means having confronting shoulders engageable by a flange on an actuator member when a dog means is retracted to shift the valve member with reciprocation of the actuator member, each of said dog means releasing said actuator member as a dog means enters its cooperating groove, and cooperating lugs and shoulder means on the body and shutter and valve member latching the shutter to the body as the valve member moves toward open position until the seal means is within the shutter and then latching the shutter to the valve member, said lugs and shoulder means also latching the shutter to the valve member as it moves toward closed position until the shutter is closed and then latching the shutter to the body.

4. A sleeve valve comprising, a tubular body having a valve seat therein, port means extending through the wall of the tubular body, a tubular sleeve valve member in said body cooperable with said seat and movable between open and closed positions to control flow through said ports, seal means on the exterior of the valve member, spaced grooves in the bore through the tubular body, a pair of spaced collets carried by said valve member and providing dog means resiliently urged outwardly to alternately cooperate with one of said spaced grooves and position the valve member alternately in open or closed positions, said spaced dog means having confronting internal shoulders engageable by a flange on an actuator member when a dog means is retracted to shift the valve member with reciprocation of the actuator member, each of said dog means releasing said actuator member as a dog means enters its cooperating groove, a valve shutter around the valve member, and cooperating lugs and shoulder means on the body and shutter and valve member latching the shutter to the body as the valve member moves toward open position until the seal means is within the shutter and then latching the shutter to the valve member, said lugs and shoulder means also latching the shutter to the valve member as it moves toward closed position until the shutter is closed and then latching the shutter to the body.

5. A valve comprising, a body having a valve seat therein, a sleeve valve member in said body cooperable with said seat and movable between open and closed positions to control flow through said valve seat, seal means on the exterior of the valve member, a valve shutter around the valve member, spaced grooves in the body with a land therebetween, spaced dog means carried by the valve member and movable laterally to alternately engage one of said spaced grooves and the land therebetween to vary the lateral position of the spaced dog means, means urging said dog means into said grooves, said spaced dog means having confronting shoulders engageable by a flange on an actuator member when a dog means is engaged by said land to shift the valve member with reciprocation of the actuator member, each of said dog means releasing said actuator member as a dog means enters its cooperating groove, cooperating lugs and shoulder means on the body and shutter and valve member latching the shutter to the body as the valve member moves toward open position until the seal means is within the shutter and then latching the shutter to the valve member, said lugs and shoulder means also latching the shutter to the valve member as it moves toward closed position until the shutter is closed and then latching the shutter to the body.

* * * * *